United States Patent [19]

Juranitch

[11] 3,942,394

[45] Mar. 9, 1976

[54] FINISHING SHARPENER AND METHOD FOR USING SAME

[76] Inventor: John R. Juranitch, 932 S. Layton Blvd., Milwaukee, Wis. 53215

[22] Filed: Jan. 20, 1975

[21] Appl. No.: 542,295

[52] U.S. Cl. ..... 76/84; 51/205 R

[51] Int. Cl.[2] ..... B24D 15/00

[58] Field of Search ..... 76/84; 51/205 R, 205 WG, 51/211 R, 212, 214

[56] References Cited

UNITED STATES PATENTS

| | | | |
|---|---|---|---|
| 221,540 | 11/1879 | Dow | 51/205 R UX |
| 1,352,888 | 9/1920 | Gallagher | 51/205 R UX |
| 1,441,948 | 1/1923 | Schrag | 51/205 R |
| 1,939,482 | 12/1933 | Aurili | 51/212 |
| 2,398,255 | 4/1946 | Schauble | 51/212 X |

*Primary Examiner*—Donald G. Kelly

*Attorney, Agent, or Firm*—Lockwood, Dewey, Zickert & Alex

[57] ABSTRACT

Finishing sharpener including a handle having a pair of wings extending therefrom and each wing being in the form of a flat bar defining a sharpening edge that is arcuate in cross section and smooth. The method of using the sharpener is concerned with the proper positioning of a knife blade relative the wings and a proper engagement between the knife edge and the sharpening edges of the wings.

14 Claims, 8 Drawing Figures

FINISHING SHARPENER AND METHOD FOR USING SAME

This invention relates in general to a finishing sharpener for applying a finishing edge to a cutting tool, and more particularly a finishing sharpener for applying a finising edge to the cutting edge of a knife blade, and stll more particularly to the method of using the finishing sharpener of the invention.

Heretofore, there have been many types of sharpening steels or finishing sharpeners for sharpening of a knife blade, such as shown in U.S. Pat. Nos. 198,668, 317,591, 618,880, 1,154,375, 1,443,259, 1,888,102, 2,058,348, and 2,380,539.

Most of the heretofore known sharpening steels have been intended for effecting a sharpening of a knife blade, and therefore the edges against which a blade is drawn are usually rough. While some sharpening steels have shown smooth surfaces against which a knife edge may be drawn, such surfaces have generally had a relatively large arcuate in cross section configuration which presents difficulties in use. Moreover, heretofore known steels have not been arranged such as to guide or assist in guiding the proper engagement between the knife blade and the steel.

The present invention obviates the above difficulties in providing a relatively simple form of finishing sharpener which may be easily and economically constructed and which may be easily used to finish the cutting edge of a knife blade.

While reference will be made herein to the finishing of knife blades, it will be appreciated that the finishing sharpener of the invention could be used for finishing the edge on any cutting tool. The finishing sharpener includes a pair of wings mounted on a handle. For convenience, the handle is hollow and the wings are foldable into the handle. However, it is important that the wings which are in the form of flat bars may be adjustably positioned relative the handle in order to properly position the wings during a finishing operation on a knife blade. The handle serves as a guide for drawing the knife blade cutting edge across the sharpening edges formed on the wings at the proper angle. It is important that the sharpening edges are provided with a smooth arcuate surface having a relatively small radius so that only a small point of the knife edge engages the sharpening edge at any one time. Thus, the sharpening edges of the wings are specially constructed to provide a arcuate in cross section surface of relatively small radial extent and of a highly smooth configuration. It may be appreciated here that the sharpening steel of the invention is not intended to remove material from the cutting edge of a knife blade but is intended to follow a properly prepared edge to produce a silky smooth edge.

Use of the finishing sharpener of the present invention is effective only when the cutting edge of a knife blade has been properly prepared, such as by sharpening on a hone or wheel. No value is obtained by using the finishing sharpener of the invention in connection with a knife blade having a dull edge. While the invention is essentially set forth so as to provide the sharpening edges by forming bar-shaped wings, it should be appreciated that the sharpening edge may be provided on a wheel. Preferably, the small angle between a knife blade and the sharpening edge during the finishing operation is between 20° and 30°. Merely the weight of the knife blade is utilized when drawing the knife blade across the sharpening edge of the sharpener.

It is therefore an object of the present invention to provide a new and improved finishing sharpener for finishing a cutting edge of a cutting tool or knife blade, which sharpener may be inexpensively and simply constructed and easy to use.

Another object of this invention resides in the provision of a new and improved finishing sharpener for applying a finish to the cutting edge of a knife blade which includes a pair of flat bar-shaped wings defining sharpening edges against which a knife blade may be drawn and wherein the wings may be adjustably positioned to properly relate the sharpening edges to a knife blade during the finishing operation.

A still further object of this invention is in the provision of a finishing sharpener for finishing the cutting edges of knife blades which provides a finish to a cutting edge materially superior to any heretofore known finishing sharpener.

Other objects, features and advantages of the invention will be apparent from the following detailed disclosure, taken in conjunction with the accompanying sheet of drawings, wherein like reference numerals refer to like parts, in which.

While the device of the present invention is referred to as a finishing sharpener, it should be appreciated that the device is not intended to sharpen blades in the sense of removing material from the blades to apply a suitable edge. The finishing sharpener of the invention is useful only once a cutting edge of a knife blade has been properly sharpened on an abrasive wheel or on a hone so that a finishing operation can be applied to the cutting edge to thereby ultimately produce a finer cutting edge which will reduce the amount of pressure necessary in cutting operations. For example, cutting of meats involves the slicing of meat by the application of cutting strokes with a knife. The better the cutting edge the lesser the work involved in cutting of the meat. It is the finishing sharpener of the present invention which will provide a silky smooth edge of the ultimate in sharpness on the cutting edge of a knife blade. This edge will last longer and may be periodically renewed by the finishing sharpener of the invention.

Figure 1:
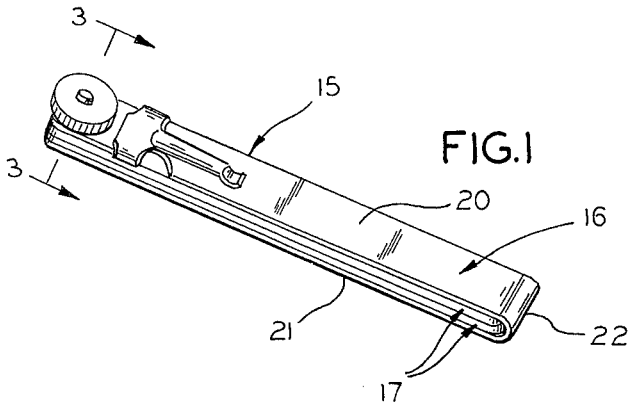
FIG. 1 is a perspective view of the finishing sharpener according to the invention in the folded and carrying position.
Figure 2:
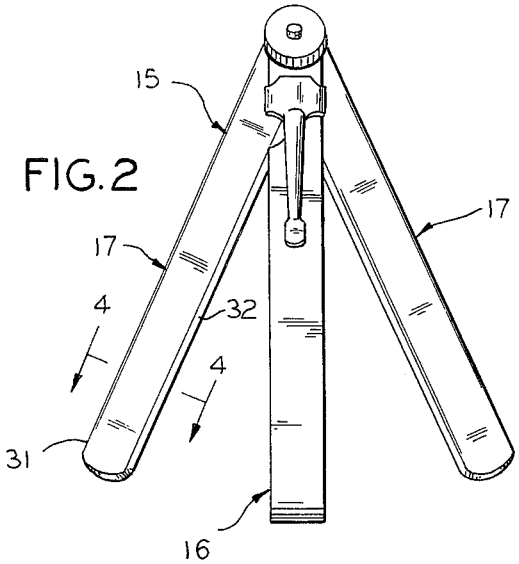
FIG. 2 is a perspective view of the sharpener showing the wings extending from the handle in the position for applying a knife edge against the sharpening edges of the sharpener.
Figure 3:
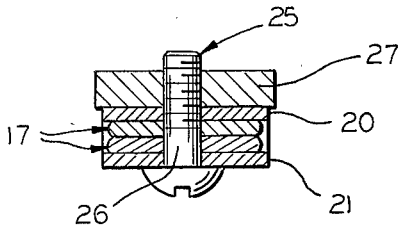
FIG. 3 is a greatly enlarged cross-sectional view taken substantially along line 3—3 of FIG. 1.
Figure 4:
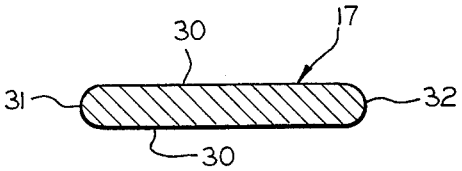
FIG. 4 is a greatly enlarged cross-sectional view taken substantially along line 4—4 of FIG. 2.

The preferred form of the finishing sharpener according to the invention is shown in FIGS. 1 to 7 and generally designated by the numeral 15. The sharpener 15 includes a handle 16 and a pair of wings 17. The handle 16 is hollow to permit the wings to be folded thereinto, as shown in FIG. 1, or to be folded outwardly, as shown in FIG. 2.

The handle 16 may be of any suitable material, such as metal or plastic, and includes upper and lower panels 20 and 21 respectively connected at one end by an arcuate bight portion 22. A fastener 25 is mounted at the other ends of the panels 20 and 21 and which includes a bolt or cap screw 26 and a nut 27. The bolt 25 extends through suitable holes formed in the handle panels 29 and 21 and also through suitable holes formed in one end of each of the wings 17. By tightening and loosening the nut 27 on the bolt 26, it will be appreciated movement and fixing the position of the wings relative to the handle can be accomplished. Accordingly, the wings 17 may be adjustably positioned relative to the handle 16. Preferably, for a finishing operation of a knife blade, the wings 17 are inclined relative the handle 16 and form an angle therewith of between 20° and 30°.

Each wing 17 is in the form of a flat bar and includes parallel opposed faces 30, 30 and parallel opposed arcuate in cross section sharpening edges 31 and 32. The thickness of the wings 17 is preferably such as to provide suitable rigidity to the wings and preferably between 0.050 and 0.250 inches. The radial extent of the arcuate edges 31 and 32 is preferably small and between 0.025 and 0.125 inches so as to provide a fine contacting edge for a knife blade cutting edge. The sharpening edges 31 and 32 are smooth as they do not function to remove metal but merely function to follow the cutting edge properly. For example, if the cutting edge includes burring or a slight bend relative the vertical axis of the blade, such will be eliminated by use of the sharpener of the invention.

The wings are preferably made of steel, such as 1020 cold rolled steel. After forming the opposite edges 31 and 32 with the desired radii, all surfaces of the wings are polished to form a fine finish on the edges. Preferably, the micro surface finish of the edges is at least 15AA. The wings are next carbon nitrided. One edge and preferably the outer edge 31 is then polished and the entire wing is then hard chromed to render it corrosion resistant. The polished edge would therefore be smoother than the unpolished nitrided edge 32. However, it is appreciated both edges could be polished and hard chromed. Preferably, a finishing operation on a knife blade cutting edge would be conducted relative to the smoothest edge of each wing, although the user could choose the rougher edge.

Figure 5:
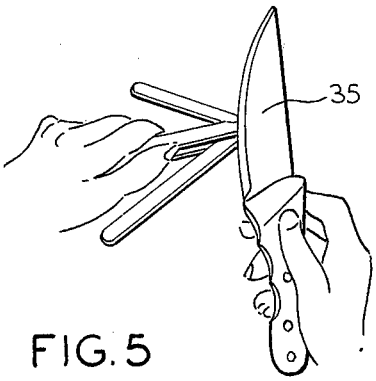
FIGS. 5 and 6 illustrate the manner in which a person may hold the finishing sharpener and a knife and the drawing of a knife edge along the sharpening edges of the sharpener.
Figure 7:
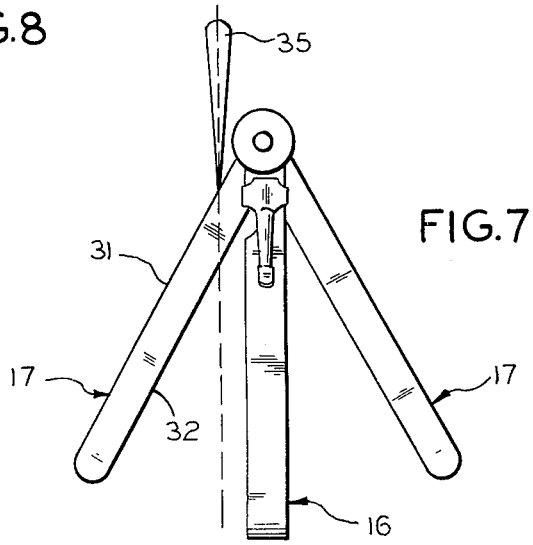
FIG. 7 is a diagrammatic front elevational view illustrating the positioning of a knife blade relative to the handle of the sharpener.
Figure 6:
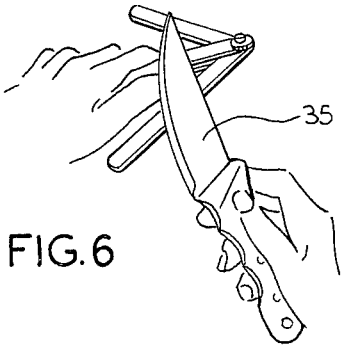

The finishing sharpener is used by grasping the handle 16 in one hand, picking up the knife with the other hand and bringing the back edge of the knife cutting edge onto the sharpening edge of the wing, such as shown in FIGS. 5 and 6. Only the weight of the knife and the hand of the person places the knife edge against the wing sharpening edge. The hand is moved to draw the knife blade along the sharpening edge of the wing and at the same time move the knife edge along the extent of the wing edge. Relative movement between the knife blade and the sharpener should be slow as a rapid motion may result in dulling the knife edge. After the cutting edge of the knife blade has been drawn against one of the wings, it is next drawn against the other of the wings to further the finishing operation. A plurality of alternate strokes will be sufficient where each successive stroke involves preferably less and less pressure so that the last strokes of the knife blade relative to the wings will barely make contact between the cutting edge of the knife and the wings. As seen in FIG. 7, it is important that the knife blade 35 extend parallel to the handle 16 of the finishing sharpener when the knife blade is drawn against the arcuate edge 31. Thus, the handle serves as a guide. The edge of the knife blade is preferably placed in contact at the upper end of each wing prior to a stroking operation. Where the knife blade is moved downwardly along the edge of the wing, it is also then pulled along the length of the knife blade so that the combined action provides a contact between nearly all of the knife blade cutting edge and nearly all of each wing. While any number of finishing operations may be performed with the finishing sharpener, about twenty strokes is usually sufficient. While the sharpener has been described as having adjustable wings, it could be appreciated the sharpener could be made with wings in a fixed position relative the handle.

Figure 8:
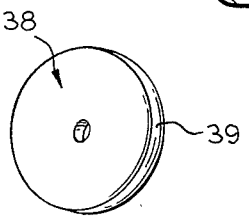
FIG. 8 is a perspective view of a modification where the sharpener is in the form of a wheel.

The embodiment of FIG. 8 differs from that of FIGS. 1 to 7 only in that the finishing sharpener is shown in the form of a wheel 38 adapted to be mounted on a rotating shaft. Again, the edge 39 defined by the relatively thin wheel will have an arcuate smooth surface like that provided on the wings of the sharpener 15. When the wheel is being power driven, the cutting edge of a knife blade may then by stroked across the edge 39 relative both sides of the knife blade to give a finishing edge to the knife blade. Again, the angle between the edge 39 and the knife blade must be maintained constant.

It will be understood that modifications and variations may be effected without departing from the scope of the novel concepts of the present invention, but it is understood that this application is to be limited only by the scope of the appended claims.

The invention is hereby claimed as follows:

1. A finishing sharpener comprising a handle and a pair of wings, said wings mounted on and extending from one end of the handle such that when the handle is vertically positioned the wings extend from the upper end thereof and downwardly at an incline, each wing having a flat body defining a rectilinear sharpening edge with a smooth surface against which a knife edge can be engaged for finish sharpening, said sharpening edge being arcuate in cross section and having a radius of relatively small extent.

2. A finishing sharpener as defined in claim 1, wherein said wings are adjustably mounted relative the handle.

3. A finishing sharpener as defined in claim 1, wherein the sharpening edge radius of each wing is no greater than 0.125 inch.

4. A finishing sharpener as defined in claim 1, wherein the sharpening edge radius of each wing is between 0.025 and 0.125 inches.

5. A finishing sharpener as defined in claim 1, wherein each wing defines parallel opposed sharpening edges and one edge having a smoother surface than the other.

6. A finishing sharpener as defined in claim 1, wherein the sharpening edge radius of each wing is polished to a minimum of 15AA micro finish.

7. A finishing sharpener as defined in claim 1, wherein the sharpening edge radius of each wing is provided with a carbon nitrided, polished and hard chrome finish.

8. A finishing sharpener as defined in claim 5, wherein one sharpening edge is provided with a carbon nitrided, polished and hard chrome finish, and the other edge is provided with a carbon nitrided finish.

9. A finishing sharpener as defined in claim 1, wherein the thickness of each wing body is between 0.050 and 0.025 inches, and the sharpening edge radius of each wing is between 0.025 and 0.125 inches.

10. A finishing sharpener as defined in claim 9, wherein one of the sharpening edges of each wing has a micro surface finish of about 15AA.

11. A finishing sharpener as defined in claim 2, wherein said handle is hollow and the wings are foldable into the handle.

12. A method of finish sharpening a knife edge on a finishing sharpener which includes a handle having a pair of wings extending from one end of the handle on opposite sides thereof and inclined thereto and each wing having a smooth edge of relatively small arcuate extent against which the knife edge engages, which method includes the steps of positioning a knife blade in parallel to the handle and the knife edge thereof first against the wing on one side of the handle and drawing the knife edge therealong over the sharpening edge while maintaining the knife blade parallel to the handle thereof, and second against the wing on the other side of the handle and drawing the knife edge therealong over the sharpening edge thereof while maintaining the knife blade parallel to the handle.

13. A method as defined in claim 12, which further includes multiple drawing of the knife edge over each of the sharpening edges.

14. A finishing sharpener comprising a handle and at least one wing, said wing being mounted on and extending from one end of the handle such that when the handle is substantially vertically positioned the wing extends from the upper end thereof and downwardly at an incline, said wing having a flat body defining a rectilinear sharpening edge with a smooth surface against which a knife edge can be engaged for finish sharpening, and said sharpening edge being arcuate in cross section and having a radius of relatively small extent.

* * * * *